US006616371B2

(12) United States Patent
Pate

(10) Patent No.: US 6,616,371 B2
(45) Date of Patent: Sep. 9, 2003

(54) COVER FOR IN-GROUND METER ENCLOSURES USED IN TRAFFIC LOADING CONDITIONS, AND METHOD FOR MAKING

(75) Inventor: Richard Pate, McDonough, GA (US)

(73) Assignee: Okie Doakie Sales, Inc., McDonough, GA (US)

( * ) Notice: Subject to any disclaimer, the term of this patent is extended or adjusted under 35 U.S.C. 154(b) by 0 days.

(21) Appl. No.: 10/097,802

(22) Filed: Mar. 13, 2002

(65) Prior Publication Data

US 2002/0090262 A1 Jul. 11, 2002

Related U.S. Application Data

(63) Continuation of application No. 09/612,692, filed on Jul. 10, 2000, now Pat. No. 6,357,962, which is a continuation of application No. 09/376,135, filed on Aug. 17, 1999, now Pat. No. 6,116,813.

(51) Int. Cl.[7] ..... E02D 29/14
(52) U.S. Cl. ..... 404/25; 137/364; 52/19
(58) Field of Search ..... 404/25, 26; 52/19, 52/20; 137/364

(56) References Cited

U.S. PATENT DOCUMENTS 1,923,481 A * 8/1933 Ford ..... 210/163
3,501,874 A * 3/1970 Hahne ..... 404/25
3,920,347 A * 11/1975 Sauriol et al. ..... 210/166
4,325,405 A * 4/1982 Christo ..... 137/370
5,130,016 A * 7/1992 Gavin ..... 210/164
5,282,339 A * 2/1994 Devlin et al. ..... 182/106
5,340,232 A * 8/1994 Spiess et al. ..... 404/25
5,595,455 A * 1/1997 Svirklys ..... 404/25
5,864,990 A * 2/1999 Tu ..... 210/163
6,151,848 A * 11/2000 Hunter ..... 29/897
6,276,093 B1 * 8/2001 Janesky ..... 52/19
6,293,055 B1 * 9/2001 Watson ..... 5/2.1
6,385,913 B1 * 5/2002 Ahn ..... 416/92

* cited by examiner

*Primary Examiner*—Gary S. Hartmann
(74) *Attorney, Agent, or Firm*—Allen, Dyer, Doppelt, Milbrath & Gilchrist, P.A.

(57) ABSTRACT

A cover for in-ground meter enclosures used in traffic loading conditions employs a relatively thin plate member formed of a ductile iron alloy and is dimensioned to extend laterally across a top opening of an in-ground meter enclosure. A plurality of relatively thick rib members of the ductile iron alloy are formed with and extend generally normal from the bottom side of the plate member. The plate member and the rib members together have sufficient strength and ductility to withstand total loads on the order of at least about 20,000 pounds on the top side of the plate member.

30 Claims, 4 Drawing Sheets

COVER FOR IN-GROUND METER ENCLOSURES USED IN TRAFFIC LOADING CONDITIONS, AND METHOD FOR MAKING

CROSS-REFERENCE TO RELATED APPLICATIONS

This application is a continuation of and incorporates by reference application Ser. No. 09/612,692, filed Jul. 10, 2000, now U.S. Pat. No. 6,357,962 which is a continuation of application Ser. No. 09/376,135, filed Aug. 17, 1999 now U.S. Pat. No. 6,116,813, which is commonly owned with the present invention and which is incorporated herein by reference.

BACKGROUND OF THE INVENTION

1. Field of the Invention

The present invention relates generally to enclosures for in-ground meters for both residential and commercial use. In particular, this invention relates to covers for such meter enclosures that are designed for use under traffic loading conditions, and a method for making those covers.

2. Description of the Prior Art

On-site water meters are commonly used to permit a utility to determine the amount of water usage by a customer. Typically, the water meter is located in a meter enclosure extending into the ground adjacent the customer's residence or commercial building, to permit easy access by the utility meter-reader. The in-ground meter enclosure may be located in an environment not subject to traffic loading conditions (i.e., where automobiles, trucks and other traffic are not likely to pass across the top of the meter enclosure) or may in fact be exposed to potential traffic loading conditions. In the past, it has been customary for the water utility to maintain two inventories of covers for meter enclosures, one for use in non-traffic conditions and the other for situations where the meter enclosure may be exposed to traffic. Meter enclosure covers for non-traffic use are generally inexpensive, lightweight and not capable of sustaining traffic loads. On the other hand, meter enclosure covers for use in traffic loading conditions are typically made of high-grade steel and are generally substantially more expensive than the first type described previously. But maintaining two different inventories for such meter covers can be quite expensive. Further, while a meter installation may initially be perceived to be in a non-traffic environment, circumstances may change and the meter cover later subjected to traffic loading. In that situation, the meter cover may be broken, creating possible personal injury hazards. Thus, there is a need for a meter enclosure cover which is relatively low in cost, but is capable of withstanding significant traffic loads.

SUMMARY OF THE INVENTION

The present invention is directed to an in-ground meter enclosure cover for use in potential traffic loading conditions, and comprises a relatively thin plate member having a pattern of interconnecting rib members extending from the bottom side and including a peripheral rib member. The plate member and the interconnecting and peripheral rib members are dimensioned and fabricated from a suitable material, preferably a ductile iron alloy, such that the composite construction has sufficient structural strength to withstand total loads of at least about 20,000 pounds on the top side of the plate member.

In the preferred embodiment, the plate member and the rib members are cast together as a unitary cover, with unitary cast joints between the intersections of the rib members.

The cover further comprises a meter access opening extending through the plate member between the top and bottom sides and intermediate between adjacent interconnecting rib members, with a meter access lid pivotally positioned in the meter access opening.

Preferably, the cover is elongated in one direction, with the rib members including interior ribs comprising at least two longitudinal ribs extending parallel to the direction of cover elongation and at least three lateral ribs extending generally normal to, and intersecting with, the longitudinal ribs at spaced unitary cast joints. The rib members all have a dimension extending normal from the bottom side which is substantially greater than the dimension of the plate member between the top and bottom sides. By way of example, the peripheral rib has a dimension from the bottom side of the plate member which is on the order of at least six times the thickness of the plate member; similarly, the interior ribs have a dimension extending from the bottom side of the plate member which is on the order of at least four times the thickness of the plate member. Preferably, a portion of one of the elongated ribs is substantially thicker adjacent to and generally parallel with the bottom side of the plate member along the meter access opening, and includes a recess adapted to support the meter access lid when closed.

THE DRAWINGS

Other important features of the present invention are described below and are illustrated in the accompanying drawing, in which.

DETAILED DESCRIPTION

Figure 1:
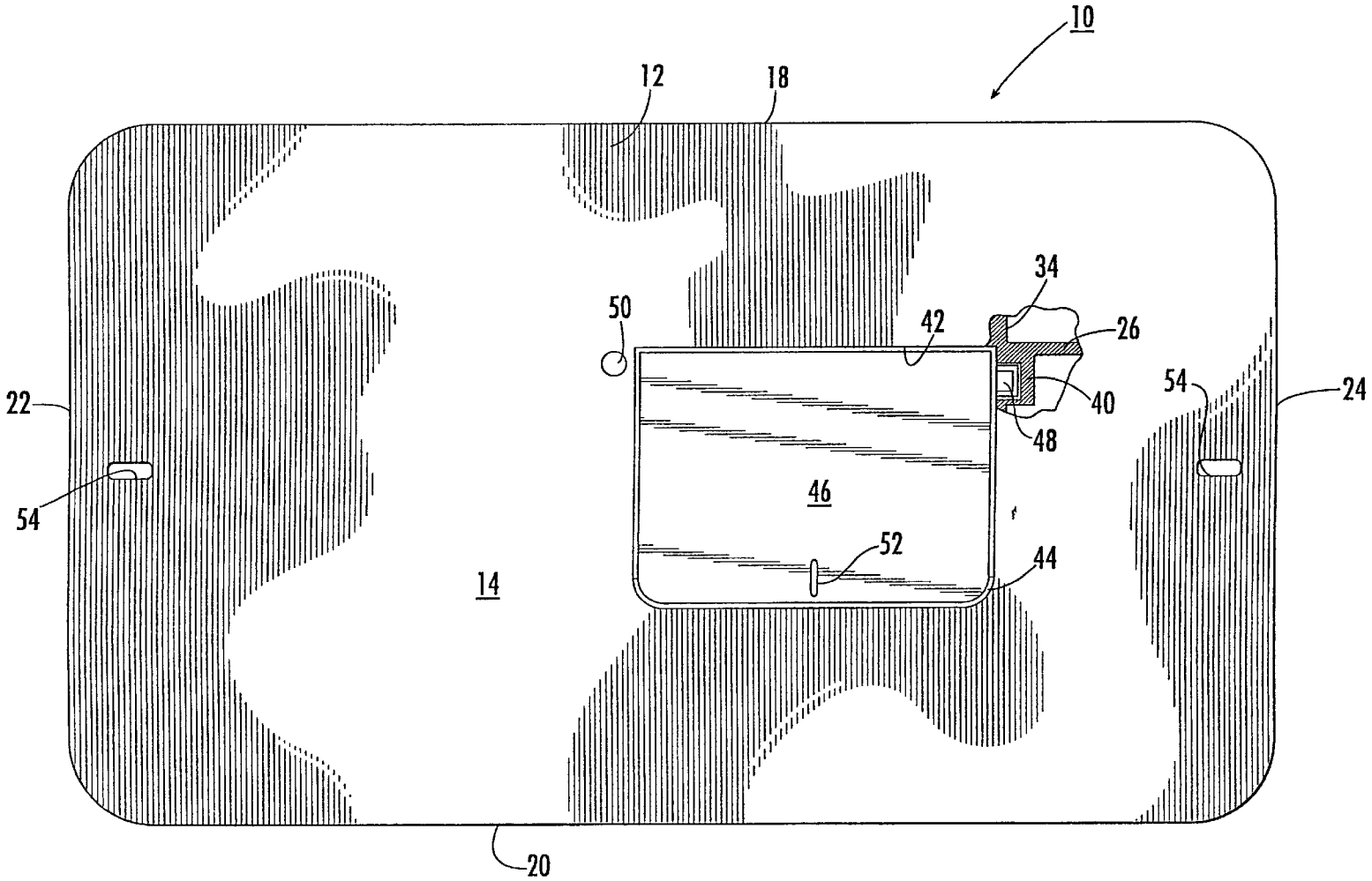
FIG. 1 is a top plan view of a meter enclosure cover in accordance with the present invention, in which a portion of the top side is cut away to illustrate details of the meter access lid and opening.

A detailed description of covers in accordance with the present invention useful with in-ground meter enclosures in potential traffic loading situations will now be described with reference to FIGS. 1–6.

First noting FIGS. 1–5, a first embodiment of the cover 10 includes a plate member 12 having a top surface 14 and a bottom surface 16. The plate member is defined by opposing elongated and parallel major sides 18, 20 and opposing parallel minor sides 22, 24.

Figure 2:
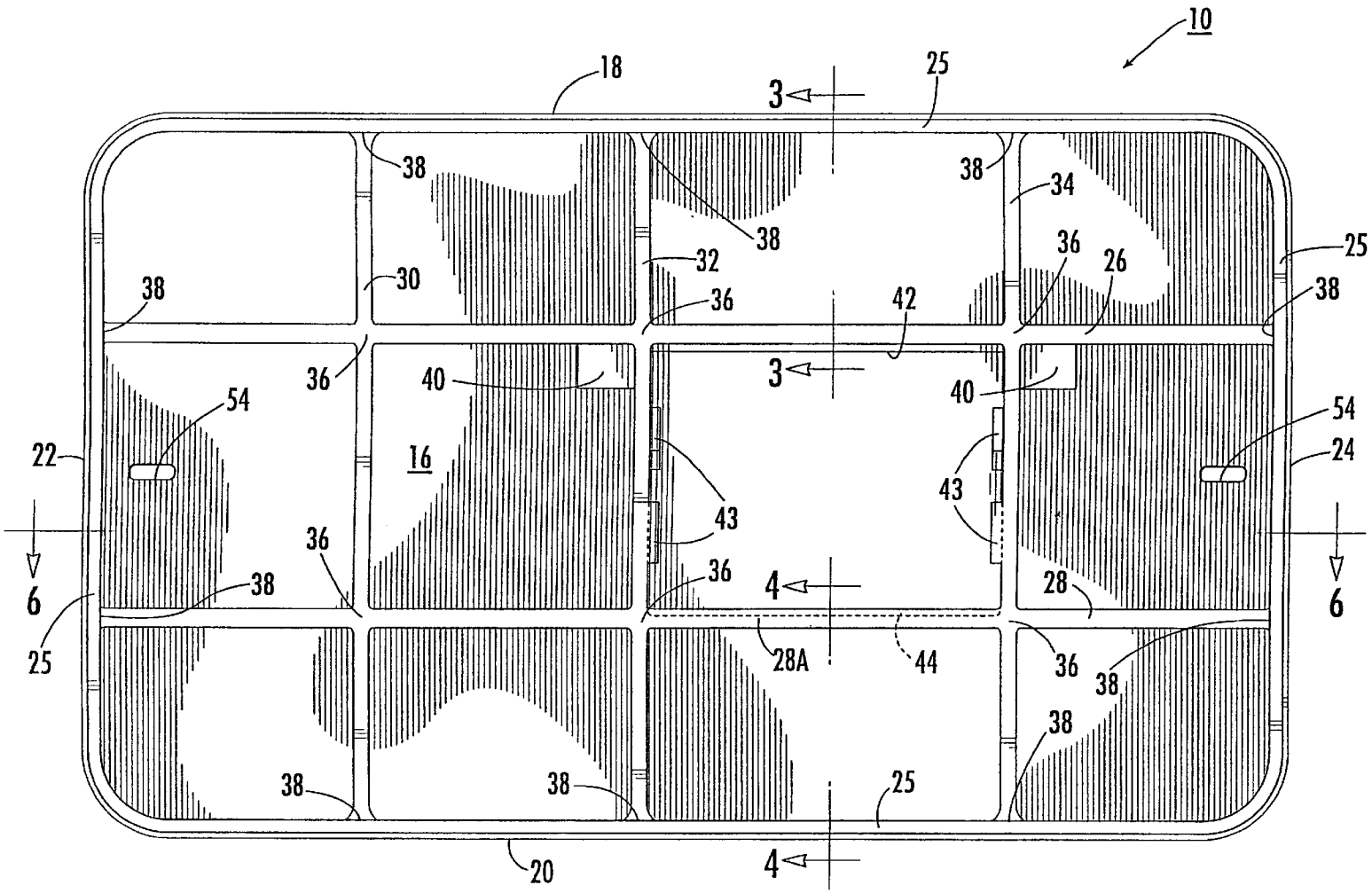
FIG. 2 is a bottom view of the enclosure cover shown in FIG. 1, with the meter access lid removed.
Figure 3:
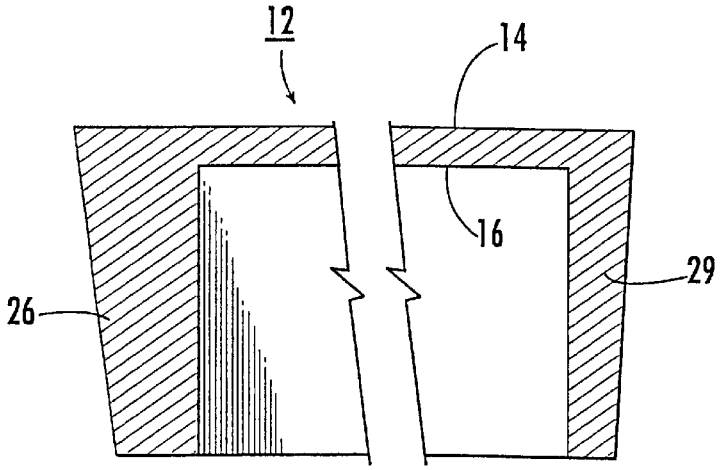
FIG. 3 is a cross section of a portion of the cover shown in FIG. 2, taken along the lines 3—3.

Referring now to FIG. 2, the cover 10 further includes a system of rib members extending generally perpendicular from the bottom side 16, including a peripheral rib 25 which extends completely about the sides 18, 20, 22 and 24. The system of rib members also includes plural intersecting rib members interiorly of the peripheral rib 25, including at least two spaced longitudinal ribs 26, 28 extending generally parallel with the major sides 18, 20 between the minor sides 22, 24 and at least three lateral ribs 30, 32 and 34 extending generally parallel to the minor sides 22, 24 and between the major sides 18, 20. Each of the interior ribs 26, 28, 30, 32 and 34 form unitary joints 36 at each point of intersection with other interior ribs and a unitary joint 38 at each point of intersection with the peripheral rib 25.

In accordance with the present invention, the system of rib members 25, 26, 28, 30, 32 and 34 all have a dimension extending generally perpendicular from the bottom side 16 which is substantially greater than the thickness of the plate member 12. By way of example, the peripheral rib 25 has a dimension which is at least three times the thickness of the plate member and preferably on the order of at least six times the thickness of the plate member. Likewise, the interior ribs 26, 28, 30, 32 and 34 all have a dimension extending from the bottom side 16 which is on the order of at least two times the thickness of the plate member 12, and preferably on the order of at least three times the thickness of the plate member. By way of example, the plate member 12 is about one-quarter inch thick between the top side 14 and the bottom side 16, and all of the ribs 25, 26, 28, 30, 32 and 34 have a dimension which is on the order of 1¼"–1¾" as measured from the bottom side 16. Alternatively, the interior ribs 26, 28, 30, 32 and 34 may be somewhat smaller in dimension than the peripheral rib 25, as discussed below with reference to the embodiment shown in FIG. 6.

Further in accordance with the present invention, the construction of the cover 10 just described is particularly suited for use with a relatively inexpensive ductile iron alloy material, which is capable of being cast in a unitary manner to form the plate member 12 and the system of rib members 25, 26, 28, 30, 32 and 34 as well as the unitary joints 36 and 38. By way of example, a suitable ductile iron alloy is designated as Grade 60-40-18 under ASTM Standard A 536-84 (1993). Grade 60-40-18 ductile iron alloy has a tensile strength on the order of 60,000 pounds per square inch minimum, a tensile strength of 414 MPa minimum, a yield strength of about 40,000 pounds per square inch minimum, and approximately 276 MPa minimum, and an elongation of about 18% minimum (elongation is 2 inches, or 50 mm.). This particular ductile iron alloy is exemplary only, and other ductile iron alloys are also suitable. For example, the other ductile iron alloys listed in the previously referenced ASTM Standard A 536-84 (1993) meet the criteria for use with the present invention.

Referring again to FIGS. 1 and 2, the cover 10 includes a meter access opening 42 and a corresponding meter access lid 46. The opening 42 and lid 46 are both preferably elongated in a direction generally parallel to the major sides 18, 20. The lid 46 includes extending trunions 48 (note FIG. 5) which are engaged in corresponding openings in trunion recess blocks 40 (FIGS. 1 and 2). Closure 50 (FIG. 1) extends into the access to the trunion 49.

Figure 4:
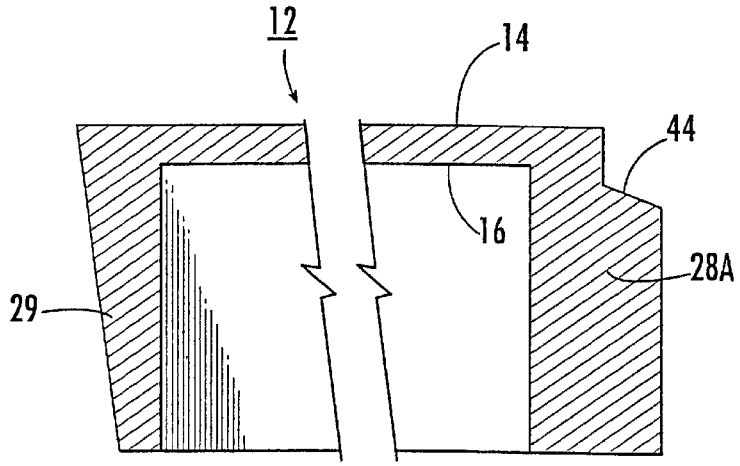
FIG. 4 is a cross section of a portion of the cover shown in FIG. 2, taken along the lines 4—4.
Figure 5:
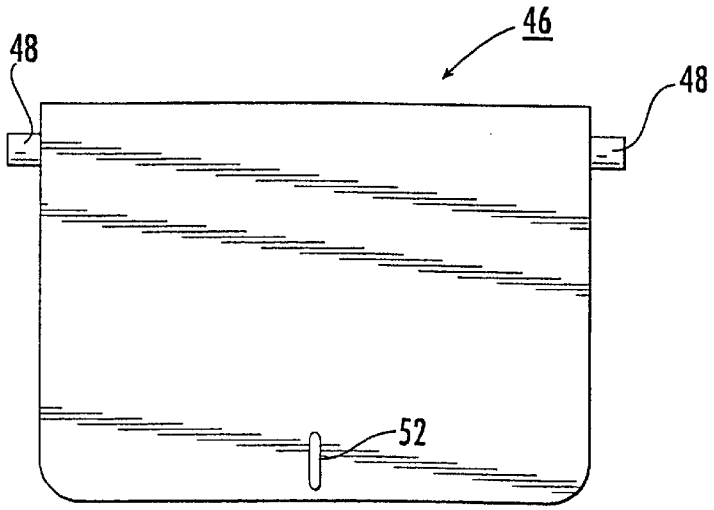
FIG. 5 is a top plan view of the meter access lid shown in FIG. 1.

As shown by dotted line in FIG. 2 and in FIG. 4, a recess 44 extends downwardly into a portion 28A of rib 28 adjacent the opening 42 in order to support the forward edge of the lid 46. Suitably, the portion 28A of rib 28 has a thicker cross-section, to account for any loading on the forward edge of the lid 46. The lid 46 includes an aperture 52 to permit a tool to be inserted for opening. Similarly, access apertures 54 are provided at opposing ends of the plate member 12.

Figure 6:
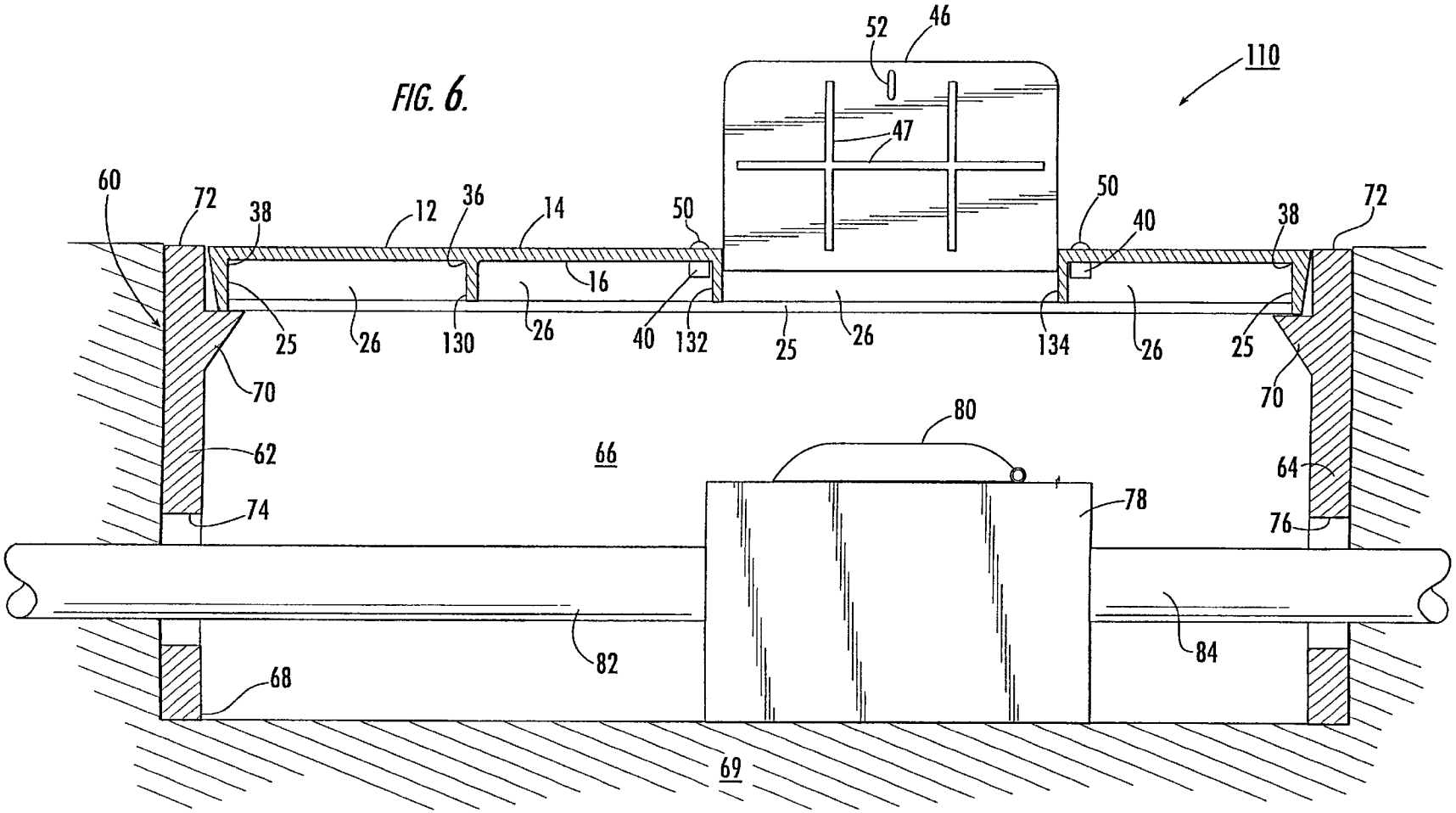
FIG. 6 is a cross sectional view of an alternate embodiment of the enclosure cover of FIGS. 1 and 2, with the cover shown installed in a conventional in-ground meter enclosure.

An alternate embodiment of the cover 110 is shown in FIG. 6, where like reference numerals are used to identify the same feature as previously described with reference to FIGS. 1–5.

The embodiment of the cover 110 shown in FIG. 6 is essentially identical to the cover 10 shown in FIGS. 1–5, except that the dimensions of the interior ribs 126, 128, 130, 132 and 134 are reduced somewhat relative to the dimension of the peripheral rib 25, in order to reduce the overall weight of the cover 110 relative to the weight of the cover 10 shown in FIGS. 1–5. It has been found that this reduction and dimension does not unduly restrict or reduce the overall strength characteristics of the cover for total loading. In fact, both the cover 10 of FIGS. 1–5 and the alternate embodiment cover 110 of FIG. 6 when constructed of the ductile iron alloy has a vertical crush capability which exceeds 20,000 pounds total, when the plate member 12 has a thickness dimension of about one quarter inch between the top and bottom sides, and with the lateral dimension of the peripheral rib 25 from the bottom side 16 being on the order of 1¾", and tapering from about ⅜" to about ¼", and with a uniform thickness for the interior ribs being on the order of about one half inch and a length of 1"–1¾".

As shown in FIG. 6, both the cover 10 and the alternate cover 110 are designed for installation in an in-ground meter enclosure 60 having opposing end walls 62, 64, sidewall 66 and an open bottom 68 extending into the ground 69. All of the enclosure walls including walls 62, 64 and 66 are provided with a peripheral cover retention shelf 70, which is typically designed to retain the cover 10 or 110 generally flush with a top surface 72 of the enclosure 60. A meter 78 having a cover 80 is positioned in the water line defined by water piping 82, 84 extending through the enclosure 60 via openings 74, 76.

It will be appreciated by those skilled in the art that the present invention provides a novel construction of a in-ground meter enclosure cover which is relatively low in cost but which is capable of sustaining very high total loading in potential traffic conditions.

What is claimed is:

1. In combination:

a meter enclosure dimensioned to be inserted into a ground area, the meter enclosure having a top opening;

a relatively thin plate member formed of a ductile iron alloy, the plate member having a length and width dimensioned to extend generally laterally across the top opening of the meter enclosure, the cover further comprising a meter access opening extending through the plate member between the top and bottom sides;

a relatively thick rib member of the ductile iron alloy formed with and extending generally normal from a bottom side of the plate member, the rib member comprising a peripheral rib surrounding the periphery of the bottom side of the plate member and at least two longitudinal ribs and at least three lateral ribs extending generally normal to, and intersecting with, the longitudinal ribs at spaced unitary joints; and wherein the plate member and the rib member together have sufficient strength and ductility to withstand total loads on the order of at least 20,000 pounds on a top side of the plate member opposing the bottom side.

2. The combination recited in claim 1 wherein the meter access opening extends centrally through the plate member.

3. The combination recited in claim 1 further comprising an intersecting pattern of interior ribs forming a pattern of both parallel and generally perpendicular ribs.

4. The combination cover recited in claim 1 wherein the longitudinal and lateral ribs intersect the peripheral rib at spaced unitary joints.

5. The combination recited in claim 4 wherein the cover further comprises a recess about a portion of the meter access opening extending from the top side of the plate member, the recess dimensioned to receive a meter access lid.

6. The combination recited in claim 5 wherein the meter access opening is generally rectangular with one of the spaced unitary joints at a corner of the meter access opening.

7. The combination recited in claim 6 wherein at least a portion of one of the interior ribs alongside the meter access opening has a lateral thickness in a direction generally parallel with the bottom side which is substantially thicker than the lateral dimension of the other interior ribs.

8. The combination recited in claim 7 wherein the recess extends from the top side only into a laterally thicker rib portion.

9. The combination recited in claim 8 wherein the laterally thicker rib portion comprises a portion of one of the longitudinally-extending interior ribs.

10. The combination recited in claim 1 wherein the plate member and the rib member are formed together as a unitary cover.

11. The combination recited in claim 10 wherein the plate member and the rib member are cast together as a unitary ductile iron alloy cover.

12. The combination claim 1 wherein the peripheral rib has a dimension from the bottom side that is on the order of at least 3 times the thickness of the plate member.

13. The combination recited in claim 1 wherein the peripheral rib has a dimension from the bottom of the plate member on the order of at least 6 times the thickness of the plate member.

14. The combination recited in claim 1 further comprising:

the meter enclosure having a cover retention shelf below the periphery of the top opening; and wherein the plate member and the relatively thick peripheral rib are dimensioned so that the relatively thick peripheral rib rests upon the retention shelf during use.

15. The combination recited in claim 14 further comprising:

the meter enclosure having a top surface; and the retention shelf, the relatively thin plate member and the relatively thick peripheral rib being dimensioned so that the top surface of the relatively thin plate member lies flush with the meter enclosure top surface when in use.

16. The combination recited in claim 15 wherein the retention shelf is a relatively uniform dimension below the top surface in the top opening of the meter enclosure.

17. The combination recited in claim 1 wherein the meter enclosure comprises opposing end walls, opposing side walls and an open bottom and wherein the top opening of the meter enclosure has a retention shelf dimensioned to receive the surrounding peripheral rib with the top side of the plate member generally flush with an upper extremity of the top opening.

18. The combination recited in claim 17 further comprising a meter positioned within the enclosure.

19. The combination recited in claim 1 wherein the interior ribs have a dimension extending from the bottom side of the plate member that is on the order of at least two times the thickness of the plate member.

20. The combination recited in claim 19 wherein the interior ribs have a dimension extending from the bottom side of the plate member that is on the order of at least 3 times the thickness of the plate member.

21. In combination:

a hollow meter enclosure dimensioned to be inserted into a ground area, the meter enclosure having a top opening and a retention shelf along an inside wall of the enclosure;

a relatively thin plate member formed of a ductile metal, the plate member having a length and width dimensioned to extend generally laterally across a top opening of an in-ground meter enclosure, the plate member further comprising means extending therethrough for permitting a meter-reading access;

a plurality of relatively thick rib members of the ductile metal formed with and extending generally normal to a bottom side of the plate member, the rib members comprising a peripheral rib substantially surrounding the periphery of the bottom side of the plate member and a pattern of ribs across the bottom side of the plate member interiorly of the peripheral rib with the plate member and the rib members cast together as a unitary ductile metal cover having sufficient strength and ductility to withstand vehicle loads from automobiles and trucks on a top side of the plate member opposing the bottom side, and wherein the retention shelf is dimensioned along the inside wall of the meter enclosure to receive the peripheral rib of the plate member while maintaining the top side of the plate member generally flush in the top opening.

22. The combination recited in claim 21, wherein the means extending through the plate member for permitting a meter-reading access comprises an opening.

23. The combination recited in claim 22, wherein the meter-reading opening extends through the plate member between adjacent interior ribs.

24. The combination recited in claim 21, wherein the interior ribs form an intersecting pattern of ribs which intersect at spaced unitary joints, which spaced joints are cast together with the plate member and the rib members.

25. The combination recited in claim 21, wherein the unitary ductile member cover has sufficient strength and ductility to withstand vehicle loads of at least 20,000 pounds on the top side.

26. The combination recited in claim 21, wherein the peripheral rib is thicker adjacent the bottom side of the plate member.

27. The combination recited in claim 26, wherein an outside edge of the, peripheral rib tapers downwardly and inwardly from the plate member.

28. The combination recited in claim 21, wherein the interior ribs comprise at least two longitudinal ribs and at least two lateral ribs.

29. The combination recited in claim 28, wherein the lateral ribs extend generally normal to the longitudinal ribs.

30. The combination recited in claim 21, further comprising:

a meter access opening extending between the top and bottom sides of the plate member; and wherein two of the longitudinal ribs and two of the lateral ribs surround the meter access opening, at least one of the surrounding ribs being thicker adjacent the meter access opening than ribs not adjacent the meter access opening.

* * * * *